US007525260B2

(12) United States Patent
Matsushima

(10) Patent No.: US 7,525,260 B2
(45) Date of Patent: Apr. 28, 2009

(54) DISCHARGE LAMP LIGHTING APPARATUS

(75) Inventor: Mitsuo Matsushima, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 11/806,818

(22) Filed: Jun. 4, 2007

(65) Prior Publication Data

US 2007/0290626 A1 Dec. 20, 2007

(30) Foreign Application Priority Data

Jun. 15, 2006 (JP) ..... 2006-166695

(51) Int. Cl.
*G05F 1/00* (2006.01)

(52) U.S. Cl. ..... 315/291; 315/276; 315/307

(58) Field of Classification Search ..... 315/209 R, 315/210–213, 219–220, 224–226, 291, 307, 315/308, 312, 324, DIG. 5, DIG. 7
See application file for complete search history.

(56) References Cited

U.S. PATENT DOCUMENTS 6,181,076 B1 * 1/2001 Trestman et al. ..... 315/224
6,804,129 B2 * 10/2004 Lin ..... 363/98
7,394,209 B2 * 7/2008 Lin et al. ..... 315/247
7,439,689 B2 * 10/2008 Honda et al. ..... 315/307
2006/0017403 A1 * 1/2006 Matsushima ..... 315/291
2006/0038513 A1 * 2/2006 Henry ..... 315/291

FOREIGN PATENT DOCUMENTS

JP A 2002-141186 5/2002
JP A 2002-359091 12/2002
JP A 2004-227864 8/2004
JP A 2005-12176 1/2005
JP A 2005-317294 11/2005
JP A 2006-140055 6/2006

* cited by examiner

*Primary Examiner*—Douglas W Owens
*Assistant Examiner*—Jimmy T Vu
(74) *Attorney, Agent, or Firm*—Oliff & Berridge, PLC

(57) ABSTRACT

There is provided a discharge lamp lighting apparatus including common lines to which the low voltage side outputs of step-up transformers having a plurality of discharge lamps connected thereto are connected, wherein the low voltage side outputs connected to the common lines include two kinds of outputs in an equal number at which respective lam currents are phase-shifted by 180 degrees from each other. The discharge lamp lighting apparatus further includes: malfunction detecting circuits which is composed of sense resistors to sense the lamp currents synthesized on the common lines and comparators to compare with a sense voltage with a predetermined reference voltage, and which outputs a malfunction detecting signal when the sense voltage exceeds the reference voltage; and a protection circuit to stop driving of bridge circuits according to the malfunction detecting signal.

6 Claims, 6 Drawing Sheets

PRIOR ART

PRIOR ART

DISCHARGE LAMP LIGHTING APPARATUS

BACKGROUND OF THE INVENTION

1. Field of the Invention

The present invention relates to a discharge lamp lighting apparatus, and particularly to a discharge lamp lighting apparatus for lighting a plurality of discharge lamps used as a backlight for a liquid crystal display device.

2. Description of the Related Art

A liquid crystal display (LCD) device is extensively used as a display device of an electronic device, and the like, and is increasingly replacing a cathode ray tube (CRT) in a personal computer or a television with a relatively large display. In an LCD device for use with such a large display, a backlight device to light a plurality of discharge lamps is used in order to achieve a sufficient display brightness in a uniform manner.

A discharge lamp is usually lit by a discharge lamp lighting apparatus including an inverter. In order to prevent smoking and firing at the time of abnormal output, such an inverter is often provided with a sense circuit to detect an abnormal lamp current flowing in a discharge lamp in the case of a short circuit or an open circuit at its output, and also with a protection circuit to perform an operation to protect circuit elements according to an output signal from the sense circuit. In a conventional backlight device for a plurality of discharge lamps as described above, a malfunction detecting circuit is provided for each of the plurality of discharge lamp in order to reliably detect problems with lamp currents.

A discharge lamp of an increased length is increasingly employed, especially, in a backlight device for a large LCD device described above, and a discharge lamp lighting apparatus to light such a discharge lamp with an increased length is adapted to light the discharge lamp such that an opposite phase voltage outputted from an inverter connected to the discharge lamp is applied to the both electrodes of the discharge lamp. In such a discharge lamp lighting apparatus, a malfunction detecting circuit for lamp currents is preferably provided at the both sides of each of the discharge lamp thus requiring the malfunction detecting circuit in a number twice as many as that of the discharge lamps.

FIG. 5 is a circuit diagram of a conventional discharge lamp lighting apparatus as described above. Referring to FIG. 5, a discharge lamp lighting apparatus 100 is adapted to light a plurality (2*n* pieces: n is an integer equal to one or larger) of U-shape cold cathode lamps La1 to La2*n* in a controlled manner, and includes a plurality of lighting circuit blocks LC1 to LCn each having a pair of discharge lamps (La1+La2)/(La3+La4)/ . . . /(La2*n*−1+La2*n*) connected thereto, a plurality of bridge circuits BR1 to BRn provided respectively at the lighting circuit blocks LC1 to LCn, and a control circuit 11 to drive the bridge circuits BR1 to BRn in a controlled manner.

The lighting circuit block LC1 includes stet-up transformers T1 and T2 (step-up transformer group), and sense circuits SC1 to SC4. The step-up transformer T1 is a two-output transformer which includes two primary windings Np11 and Np12 connected in series to each other, and two secondary windings Ns11 and Ns12 independent of each other, and also the step-up transformer T2 is a two-output transformer which includes two primary winding Np21 and Np22 connected in series to each other, and two secondary windings Ns21 and Ns22 independent of each other. In the step-up transformer T1, the secondary winding Ns11 has its high voltage side output connected to one electrode of the discharge lamp La1 and its low voltage side output connected to the sense circuit SC1, and the secondary winding NS12 has its high voltage side output connected to the other electrode of the discharge lamp La1 and its low voltage side output connected to the sense circuit SC2. Likewise, in the step-up transformer T2, the secondary winding Ns21 has its high voltage side output connected to one electrode of the discharge lamp La2 and its low voltage side output connected to the sense circuit SC3, and the secondary winding NS22 has its high voltage side output connected to the other electrode of the discharge lamp La2 and its low voltage side output connected to the sense circuit SC4.

The sense circuit SC1 includes a sense resistor Ra1, diodes Da1 and Dc1, and comparators CPo1 and CPs1. The sense resistor Ra1 has its one terminal connected to the low voltage side output of the secondary winding Ns11 of the step-up transformer T1 and its other terminal connected to ground. The anodes of the diodes Da1 and Dc1 are connected to the connection point between the low voltage side output of the secondary winding Ns11 and the sense resistor Ra1. The output from the cathode of the diode Da1 is applied to the positive input terminal (+) of the comparator CPo1 and to the negative input terminal (−) of the comparator CPs1, and predetermined reference voltages Vth1 and Vth2 are applied respectively to the negative input terminal (−) of the comparator CPo1 and the positive input terminal (+) of the comparator CPs1. And, the anode of a diode is connected to the output terminal of each of the comparators CPo1 and CPs1, and the cathodes of respective diodes are connected to each other.

The other sense circuits SC2, SC3 and SC4 are structured identically with the sense circuit SC1, and are connected to the low voltage side outputs of the respective secondary windings Ns12, Ns21 and Ns22 in the same way as the sense circuit SC1. Also, the lighting circuit blocks LC2 to LCn are structured identically with the lighting circuit block LC1.

In the lighting circuit blocks LC1 to LCn structured as described above, all the cathodes of the diodes Dc1 to Dc4*n* are connected to one common line which is connected to ground via a sense resistor Rc1. The connection point between the sense resistor Rc1 and the common line is connected to an error amplifier 22 of the control circuit 11. On the other hand, all the cathodes of the diodes connected to the output terminals of the comparators CPo1 to CPo4*n* and the comparators CPs1 to CPs4*n* are connected to another common line that is different from the common line connected to the diodes Dc1 to Dc4*n*, and that is connected to a protection circuit 25 of the control circuit 11.

The bridge circuit BR1 connected to the lighting circuit block LC1 is a full-bridge circuit structured such that a series circuit composed of switch elements Q1 and Q3 and connected across a DC power supply Vin is connected in parallel to a series circuit composed of switch elements Q2 and Q4, and the series connected primary windings Np11+Np12 of the step-up transformer T1 and the series connected primary windings Np21+Np22 of the step-up transformer T2 are connected in parallel to each other between the connection point of the switch elements Q1 and Q3 and the connection point of the switch elements Q2 and Q4.

Also, the bridge circuits BR2 to BRn which are identical with the bridge circuit BR1 are connected respectively to the lighting circuit blocks LC2 to LCn in the same way, and common gate driving signals d1 to d4 sent from the control circuit 11 are supplied respectively to the switch elements Q1 to Q4 of each of the bridge circuits BR1 to BRn.

Description will now be made on a normal time lighting operation of the discharge lamp lighting apparatus 100. The control circuit 11 mainly includes an oscillation circuit 21 as a CR oscillation circuit, the aforementioned error amplifier 22, a PWM circuit 23, a logic circuit 24, and the aforementioned protection circuit 25. The oscillation circuit 21 generates a triangular wave 21*a* at a predetermined frequency corresponding to the values of an external resistor 26 and an external capacitor 27 and sends to the PWM circuit 23. The error amplifier 22 compares between the voltage of a feedback signal 22*b* and a predetermined reference voltage Vref and supplies the PWM circuit 23 with an output 22*a* having a voltage corresponding to the difference therebetween. The PWM 23 compares the triangular wave 21*a* and the output 22 of the error amplifier 22, generates a predetermined PWM pulse 23*a* and sends to the logic circuit 24. The logic circuit 24 generates appropriate gate driving signals d1 to d4 according to the triangular wave 21*b* sent from the oscillation circuit 21 so as to alternately switch on and off two pairs of switch elements, one of which is composed of the switch elements Q1 and Q4, and the other of which is composed of the switch elements Q2 and Q3, whereby the bridge circuits BR1 to BRn are driven.

Thus, in the discharge lamp lighting apparatus 100, an AC voltage with a predetermined frequency is generated at the primary side of each of the step-up transformers T1 to T2*n*, and the AC voltage generated is boosted by the step-up transformers T1 to T2*n*, wherein two outputs of each of the step-up transformers T1 to T2*n* are arranged such that voltages having their respective phases reversed from each other are applied to both electrodes of the discharge lamps La1 to La2*n* which are connected to the respective high voltage sides of the two outputs, whereby the discharge lamps La1 to La2*n* are efficiently lit in a controlled manner.

During this lamp lighting operation, the lamp currents flowing in the discharge lamps La1 to La2*n* are rectified by the diodes Dc1 to Dc4*n* of the sense circuits SC1 to SC4*n*, and the maximum current of the lamp current flowing in each of the discharge lamps La1 to La2*n* is converted into the feedback signal (voltage) 22*b* by the sense resistor Rc1, and the feedback signal (voltage) 22*b* is inputted to the error amplifier 22 of the control circuit 11.

The control circuit 11 controls the switching operation of the bridge circuits BR1 to BRn by the PWM method according to the feedback signal (voltage) 22*b* thereby regulating the electric power supplied to the step-up transformers T1 to T2*n*, which enables control of the lamp currents of the plurality of discharge lamps La1 to La2*n*.

Further, in the sense circuits SC1 to SC4*n*, the sense voltages generated at the sense resistors Ra1 to Ra4 are rectified by the respective diodes Da1 to Da4*n* and inputted to the comparators CPo1 to CP04*n* and the comparators CPs1 to CPs4*n*, whereby the sense circuits SC1 to SC4*n* are enabled to detect an abnormal lamp current.

For example, in the lighting circuit block LC1, if the lighting circuit for the discharge lamp La1 is short circuited, or if the discharge lamp La1 is broken, the lamp current flowing in the lighting circuit for the discharge lamp La1 is caused to increase. With such an increase of the lamp current, the sense voltage inputted to at least one of the comparators CPo1 and CPo2 becomes higher than the normal voltage. When this voltage exceeds the predetermined reference voltage Vth1, a voltage 25*b* outputted from the comparator CPo1 and/or CPo2 is switched from a low level to a high level.

Also, if a connector open circuit occurs in the lighting circuit block (discharge lamp connector open), or if a lamp open circuit occurs (discharge lamp coming off), the lamp current flowing in the discharge lamp La1 is caused to decrease. With such a decrease of the lamp current, the sense voltage inputted to at least one of the comparators CPs1 and CPs2 becomes lower than the normal voltage. When this voltage comes down below the predetermined reference voltage Vth2, a voltage 25*b* outputted from the capacitor CPs1 and/or CPs2 is switched from a low level to a high level.

Since the outputs from the comparators CPo1 to CPo4 are OR-connected to the respective outputs from the comparators CPs1 to CPs4 via respective diodes, when a transition to a high level occurs by any one of the outputs from those comparators, the voltage 25*b* to be inputted to the protection circuit 25 of the control circuit 11 becomes a high level indicating detection of malfunction. When the voltage 25*b* becomes a high level, the protection circuit 25 outputs a drive stop signal 25*a* to the logic circuit 24, whereby the logic circuit 24 stops generation of the gate driving signals d1 to d4 thus stopping driving of the bridge circuits BR1 to BRn.

In this connection, in a discharge lamp lighting apparatus for a plurality of discharge lamps, which is used in a backlight for a large LCD television, a number of sense circuits are required corresponding to the number of discharge lamps (for example, the discharge lamp lighting apparatus 100 requires the sense circuits SC1 to SC4*n* in a number twice as many as that of the discharge lamps La1 to La2*n*) as described above, and consequently the component and production costs are pushed up, and at the same time a larger mounting space is required thus increasing the apparatus size.

In order to deal with the above problem, an inverter apparatus to drive discharge lamps is disclosed which includes a protection circuit adapted to sense lamp currents flowing in the low voltage side electrodes of the discharge lamps, to synthesize the lamp currents sensed, and to cause the inverter apparatus to cease its operation when the value of the synthesized lamp currents is lower than the reference current value (refer to, for example, Japanese Patent Application Laid-Open No. 2005-317294).

FIG. 6 is a circuit diagram of a conventional inverter apparatus 200 for lighting three discharge lamps as disclosed in the aforementioned Japanese Patent Application Laid-Open No. 2005-371294. In the inverter apparatus 200, respective lamp currents in discharge lamps 1*a*, 1*b* and 1*c* are sensed by current sensing resistors R1*a*, R1*b* and R1*c* each disposed between the low voltage side electrode of the discharge lamp 1*a*/1*b*/1*c* and ground such that the lamp currents are converted into voltages. The voltages are rectified by rectification circuits which are respectively composed of resistors R2*a*, R2*b* and R2*c* and diodes D1*a*, D1*b* and D1*c*, and which are disposed in parallel to the current sensing resistors R1*a*, R1*b* and R1*c*. The outputs of the rectification circuits are synthesized by diodes D2*a*, D2*b* and D2*c* into a synthetic feedback to be inputted to the positive terminal (+) of a comparator 3 via a feedback resistor R3. A reference voltage is inputted to the negative terminal (−) of the comparator 3.

The aforementioned reference voltage is set to be lower than the normal value of the synthetic feedback input and higher than the abnormal value thereof, and when the inverter apparatus 200 operates normally, the synthetic feedback input voltage applied to the positive terminal (+) of the comparator 3 is higher than the reference voltage, and the output of the comparator 3 becomes a high level. When the output of the comparator 3 is at a high level, a switch element Q201 is turned on, and the switch element Q201 performs a normal oscillating operation.

When a discharge lamp is broken or is not lit, or when a wire is broken at a lighting circuit, the lamp current is caused to lower thus lowering the synthetic feedback input voltage. And, when the input voltage to the positive terminal (+) of the comparator 3 becomes lower than the reference voltage, the output of the comparator 3 becomes a low level, and the switch element Q201 is turned off, and the switch element Q201 is caused to cease its oscillation.

According to the aforementioned Japanese Patent Application Laid-Open No. 2005-317294, an inverter apparatus can be provided less expensively which features the operation described above, and incorporates a protection circuit favorably comparing in terms of practical performance with circuits previously available.

The inverter apparatus 200 of FIG. 6, however, requires the current sensing resistors R1*a* to R1*c*, the rectifier diodes D1*a* to D1*c*, and the synthesizer diodes D2*a* to D2*c* for a feedback input, thus failing to achieve a significant reduction of components for a sense circuit and rather resulting in increase of the number of components for the sense circuit in proportion to the number of discharge lamps. And, since the sense voltages of the lamp currents are synthesized by the diode D2*a* to D2*c*, the sensing accuracy is deteriorated.

SUMMARY OF THE INVENTION

The present invention has been made in light of the above problems, and it is an object of the present invention to provide a discharge lamp lighting apparatus in which a sense circuit to detect a malfunction at a circuit to light a discharge lamp is simply and inexpensively structured, and a protection circuit functions reliably.

In order to achieve the object described above, according to an aspect of the present invention, there is provided a discharge lamp lighting apparatus to light a plurality of discharge lamps, which includes: a step-up transformer group including at least one step-up transformer and having a plurality of outputs to which the plurality of discharge lamps are connected; at least one bridge circuit connected to an input side of the step-up transformer group; and a control circuit to drive the bridge circuit in a controlled manner. The discharge lamp lighting apparatus also includes: at least one first common line to which at least two low voltage side outputs of the plurality of the outputs of the step-up transformer group are connected, wherein the low voltage side outputs connected to the first common line include two kinds of outputs provided in an equal number, and lamp currents flowing respectively in the two kinds of outputs are phase-shifted by 180 degrees from each other; a malfunction detecting circuit which includes a first sense resistor to convert into a sense voltage a synthetic current of the lamp currents synthesized on the first common line and a comparator to compare the sense voltage with a predetermined reference voltage, and which outputs a malfunction detecting signal when the sense voltage exceeds the reference voltage; and a protection circuit to stop driving of the bridge circuit when the malfunction detecting circuit outputs the malfunction detecting signal.

Since the discharge lamp lighting apparatus includes at least one first common line to which at least two low voltage side outputs of the plurality of the outputs of the step-up transformer group are connected, and since the low voltage side outputs connected to the first common line include two kinds of outputs provided in an equal number such that lamp currents flowing respectively in the two kinds of outputs are phase-shifted by 180 degrees from each other, the lamp currents of the plurality of discharge lamps flowing in the low voltage side outputs are synthesized on the first common line, wherein at the time of normal operation, the lamp currents phased-shifted by 180 degrees from each other cancel out each other thus making a synthetic current substantially zero, and at the time of abnormal operation, the balance of the lamp currents is disturbed thus generating a certain synthetic current, whereby the lamp current abnormality in the lighting circuits to which the plurality of discharge lamps are connected can be detected by means of the first sense resistor common for the plurality of discharge lamps and one malfunction detecting circuit including the first sense resistor.

In the aspect of the present invention, the discharge lamp lighting apparatus may further include: a plurality of current sensing circuits disposed at the low voltage side outputs of the plurality of outputs of the step-up transformer group and functioning to a lamp current of each of the discharge lamps; a second common line connected to outputs of the plurality of current sensing circuits; and a second sense resistor which has its one terminal connected to the second common line and has its other terminal connected to ground potential, and which converts the maximum of the lamp current of each of the discharge lamps into a sense voltage, wherein the sense voltage of the second sense resistor is feedbacked to the control circuit as a feedback signal, whereby the lamp currents of the plurality of discharge lamps can be controlled.

In the aspect of the present invention, the current sensing circuit may include a resistor and a diode.

In the aspect of the present invention, the protection circuit may constitute part of the control circuit.

In the aspect of the present invention, the malfunction detecting circuit may be disposed at the first common line to which low voltage side outputs of outputs out of the plurality of outputs of the step-up transformer group, high voltage side outputs of which are connected to one electrodes of the discharge lamps, are connected, and low voltage side outputs of remaining outputs out of the plurality of outputs of the step-up transformer group, high voltage side outputs of which are connected to the other electrodes of the discharge lamps, may be for controlling the lamp currents.

With the structured described above, the discharge lamp lighting apparatus according to the present invention is provided with a lower cost sense circuit with a simplified structure compared with conventional circuits and is enabled to reliably protect lighting circuits to light the discharge lamps at the time of abnormal operation. Also, since the circuit structure is simplified, the discharge lamp lighting apparatus can be easily downsized.

DETAILED DESCRIPTION OF THE INVENTION

Figure 1:
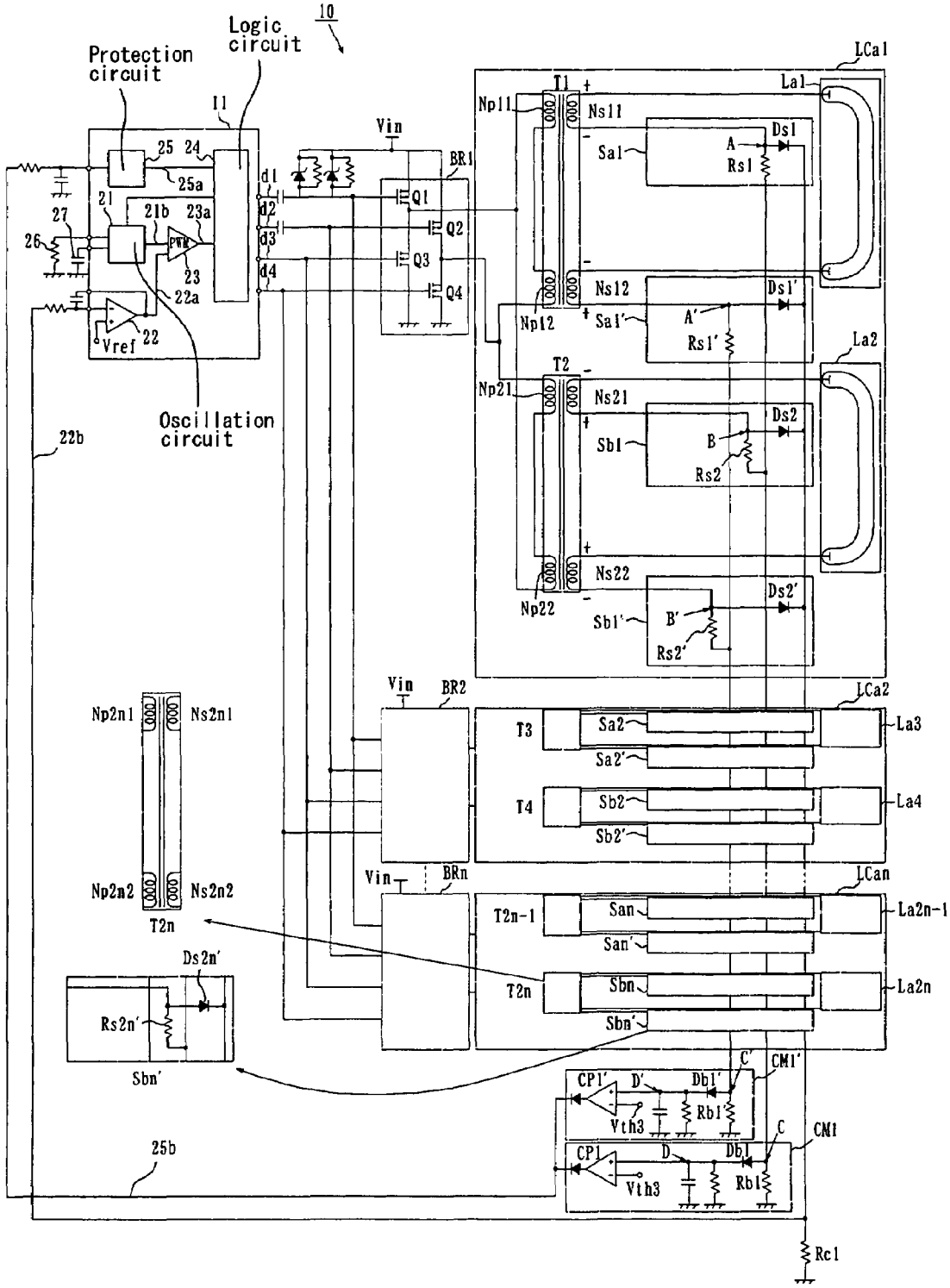
FIG. 1 is a circuit diagram of a discharge lamp lighting apparatus according to a first embodiment of the present invention.

Exemplary embodiments of the present invention will be described with reference to the accompanying drawings. In explaining the embodiments, like reference numerals refer to like elements for the drawings, and redundant explanations of the same elements will be omitted as appropriate.

A first embodiment of the present invention will be described with reference to FIG. 1. A discharge lamp lighting apparatus 10 according to the first embodiment has the same basic structure as the above-described discharge lamp lighting apparatus 100 of FIG. 5 and is provided with a circuitry identical with that of the conventional discharge lamp lighting apparatus 100 except lighting circuit blocks LCa1 to LCan and malfunction detecting circuits CM1 and CM1', and description will be focused on the features of the present invention with explanations of the identical portions omitted as appropriate.

Figure 5:
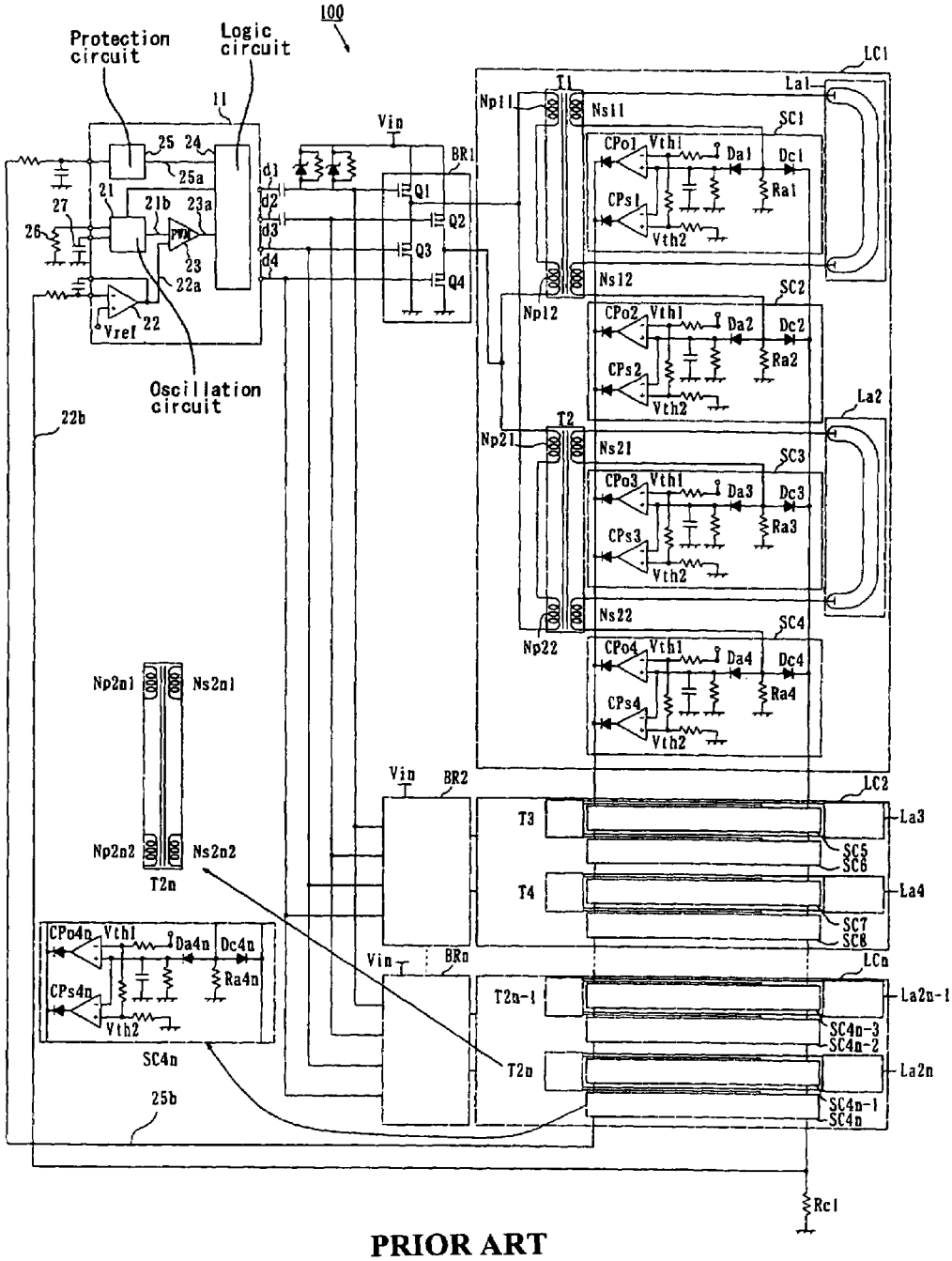
FIG. 5 is a circuit diagram of a conventional discharge lamp lighting apparatus.
Figure 6:
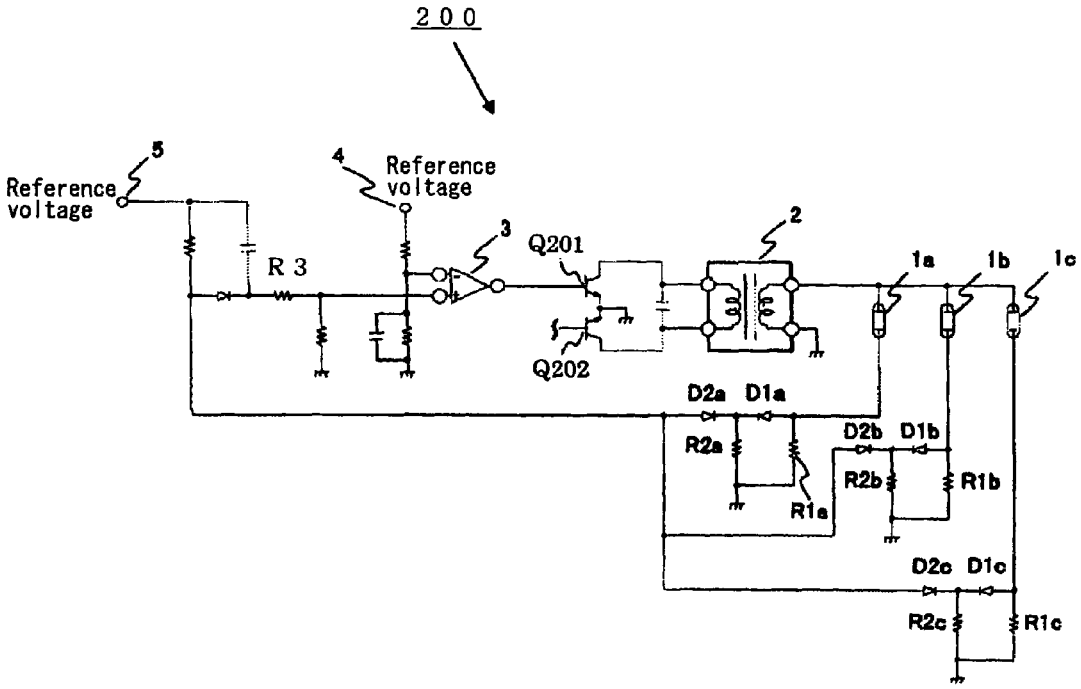
FIG. 6 is a circuit diagram of another conventional discharge lamp lighting apparatus.

Referring to FIG. 1, the discharge lamp lighting apparatus 10 is adapted to light, in a controlled manner, a plurality (2*n* pieces in the figure) of discharge lamps La1 to La2*n* each constituted by a U-shape cold cathode lamp like the discharge lamp lighting apparatus 100 of FIG. 5, and includes: the aforementioned lighting circuit blocks LCa1, LCa2, . . . and LCan to which respective pairs of discharge lamps La1+La2, La3+La4, . . . and La2*n*−1+La2*n* are connected; the aforementioned malfunction detecting circuits CM1 and CM1' connected to the lighting circuit blocks LCa1 to LCan; bridge circuits BR1 to BRn provided corresponding respectively to the lighting circuit blocks LCa1 to LCan; and a control circuit 11 to drive the bridge circuits BR1 to BRn in a controlled manner.

The lighting circuit block LCa1 includes step-up transformers T1 and T2 defined as a step-up transformer group, and current sensing circuits Sa1, Sa1', Sb1 and Sb1'. The step-up transformer T1 has two outputs and includes two primary windings Np11 and Np12 connected in series to each other and two secondary windings Ns11 and Ns12 independent of each other, and likewise the step-up transformer T2 has two outputs and includes two primary windings Np21 and Np22 connected in series to each other and two secondary windings Ns21 and Ns22 independent of each other.

The series connection of the primary windings Np11+Np12 of the step-up transformer T1 and the series connection of the primary windings Np21+Np22 of the step-up transformer T2 are connected in parallel to each other between the connection point of switch elements Q1 and Q3 of the bridge circuit BR1 and the connection point of switch elements Q2 and Q4 of the bridge circuit BR1.

In the step-up transformer T1, one terminal of the secondary winding Ns11 constitutes a high voltage side output and is connected to one electrode of the discharge lamp La1 while the other terminal of the secondary winding Ns11 constitutes a low voltage side output and is connected to the current sensing circuit Sa1, and one terminal of the secondary winding Ns12 constitutes a high voltage side output and is connected to the other electrode of the discharge lamp La1 while the other terminal of the secondary winding Ns12 constitutes a low voltage side output and is connected to the current sensing circuit Sa1'. In the step-up transformer T2, in the same way, one terminal of the secondary winding N21 constitutes a high voltage side output and is connected to one electrode of the discharge lamp La2 while the other terminal of the secondary winding Ns21 constitutes a low voltage side output and is connected to the current sensing circuit Sb1, and one terminal of the secondary winding Ns22 constitutes a high voltage side output and is connected to the other electrode of the discharge lamp La2 while the other terminal of the secondary winding Ns22 constitutes a low voltage side output and is connected to the current sensing circuit Sb1'.

The current sensing circuit Sa1/Sb1 includes a resistor Rs1/Rs2 and a diode Ds1/Ds2. One terminal of the resistor Rs1 is connected to the low voltage side output of the secondary winding Ns11 of the step-up transformer T1, and the anode of the diode Ds1 is connected to the connection point of the secondary winding Ns11 and the resistor Rs1. One terminal of the resistor Rs2 is connected to the low voltage side output of the secondary winding Ns21 of the step-up transformer T2, and the anode of the diode Ds2 is connected to the connection point of the secondary winding Ns21 and the resistor Rs2. And, the other terminals of the resistors Rs1 and Rs2 that are not connected to the secondary windings Ns11 and Ns21 are connected to each other.

In the same way, the current sensing circuit Sa1'/Sb1' includes a resistor Rs1'/Rs2' and a diode Ds1'/Ds2'. One terminal of the resistor Rs1' is connected to the low voltage side output of the secondary winding Ns12 of the step-up transformer T1, and the anode of the diode Ds1' is connected to the connection point of the secondary winding Ns12 and the resistor Rs1'. One terminal of the resistor Rs2' is connected to the low voltage side output of the secondary winding Ns22 of the step-up transformer T2, and the anode of the diode Ds2' is connected to the connection point of the secondary winding Ns22 and the resistor Rs2'. And, the other terminals of the resistors Rs1' and Rs2' that are not connected to the secondary windings Ns12 and Ns22 are connected to each other.

The other lighting circuit blocks LCa2 to LCan have the same structure as the lighting circuit block LCa1 as described above. The terminals of the resistors Rs1 to Rs2*n* of the current sensing circuits Sa1 to San and Sb1 to Sbn, which are not connected to the secondary windings, are connected to a common line e1 (first common line) which is connected to the malfunction detecting circuit CM1. In the same way, the terminals of the resistors Rs1' to Rs2*n*' of the current sensing circuits Sa1' to San' and Sb1' to Sbn', which are not connected to the secondary windings, are connected to a common line e2 (another first common line) which is connected to the malfunction detecting circuit CM1'.

The cathodes of the diodes Ds1 to Ds2*n* and Ds1' to Ds2*n*' of the current sensing circuits Sa1 to San and Sb1 to Sbn are all connected to a common line f (second common line) which is connected to one terminal of a sense resistor Rc1 (second sense resistor) which has its other terminal grounded, and an error amplifier 22 of the control circuit 11 is connected to the connection point of the common line f and the sense resistor Rc1.

The malfunction detecting circuit CM1 includes a sense resistor Rb1 (first sense resistor), a diode Db1 and a comparator CP1. The sense resistor Rb1 has its one terminal connected to the common line e1 and its other terminal grounded. The diode Db1 has its anode connected to the connection point of the common line e1 and the sense resistor Rb1 and its cathode connected to the positive input terminal (+) of the comparator CP1. And, the comparator CP1 has its negative input terminal (−) applied with a predetermined reference voltage Vth3 and its output terminal connected to the anode of a diode.

The malfunction detecting circuit CM1' has the same structure as the malfunction detecting circuit CM1. The cathode of a diode connected to the output terminal of a comparator CP1' of the malfunction sensing circuit CM1' is connected to the cathode of the diode connected to the output terminal of the comparator CP1, and a protection circuit 25 of the control circuit 11 is connected to the connection point of the cathodes of the both diodes.

In the discharge lamp lighting apparatus 10 described above, the low voltage side outputs of one secondary windings Ns11, Ns21, . . . and Ns2*n* 1 of the step-up transformers T1, T2, . . . and T2*n* are connected to the common line e1 via the resistors Rs1, Rs2, . . . and Rs2*n* of the current sensing circuits Sa1, Sb1, Sa2, . . . and Sbn. The aforementioned outputs connected to the common line e1 are divided into two groups such that one group includes n pieces of outputs of the secondary windings Ns11, Ns31, . . . and Ns2*n*−1 1 of the step-up transformers T1, T3, . . . and T2*n*−1, from which lamp currents flow to the current sensing circuits Sa1 to San, and the other group includes n pieces of outputs of the secondary windings Ns21, Ns41, . . . and Ns2*n* 1 of the step-up transformers T2, T4, . . . and T2*n*, from which lamp currents flow to the current sensing circuits Sb1 to Sbn, wherein the step-up transformers T1 to T2*n* are arranged such that the lamp currents flowing from the respective outputs of the two groups are phase-shifted by 180 degrees from each other.

In the same way, the low voltage side outputs of one secondary windings Ns12, Ns22, . . . and Ns2*n* 2 of the step-up transformers T1, T2, . . . and T2*n* are connected to the common line e2 via the resistors Rs1', Rs2', . . . and Rs2*n*' of the current sensing circuits Sa1', Sb1', Sa2', . . . and Sbn'. The aforementioned outputs connected to the common line e2 are divided into two groups such that one group includes n pieces of outputs of the secondary windings Ns12, Ns32, . . . and Ns2*n*−1 2 of the step-up transformers T1, T3, . . . and T2*n*−1, from which lamp currents flow to the current sensing circuits Sa1' to San', and the other group includes n pieces of outputs of the secondary windings Ns22, Ns42, . . . and Ns2*n* 2 of the step-up transformers T2, T4, . . . and T2*n*, from which lamp currents flow to the current sensing circuits Sb1' to Sbn', wherein the lamp currents flowing from the respective outputs of the two groups are phase-shifted by 180 degrees from each other.

In this connection, the low voltage side outputs of outputs which have their high voltage side outputs connected to respective one electrodes of the discharge lamps are connected to the common line e1 or e2 such that the low voltage side outputs of two outputs (for example, the secondary windings Ns11 and Ns12 of the step-up transformer T1) which have their high voltage side outputs connected respectively to both electrodes of one same discharge lamp are not connected to the same common line.

Description will now be made on the operation of the discharge lamp lighting apparatus 10 with reference to FIG. 2 which shows signal waveforms at points A and B (or A' and B') in the lighting circuit block LCa1, and at points C and D (or C' and D') in the malfunction detecting circuit CM1 (or CM1').

In the discharge lamp lighting apparatus 10, lamp currents flowing in lighting circuits at one electrodes of the discharge lamps La1 to La2*n* are synthesized by the resistors Rs1 to Rs2*n* of the sense circuits Sa1 to San and Sb1 to Sbn and are detected as synthesized voltages by the sense resistor Rb1 of the malfunction detecting circuit CM1, and lamp currents flowing in lighting circuits at the other electrodes of the discharge lamps La1 to La2*n* are synthesized by the resistors Rs1' to Rs2*n*' of the sense circuits Sa1' to San' and Sb1' to Sbn' and are detected as synthesized voltages by the sense resistor Rb1' of the malfunction detecting circuit CM1'.

Figure 2:
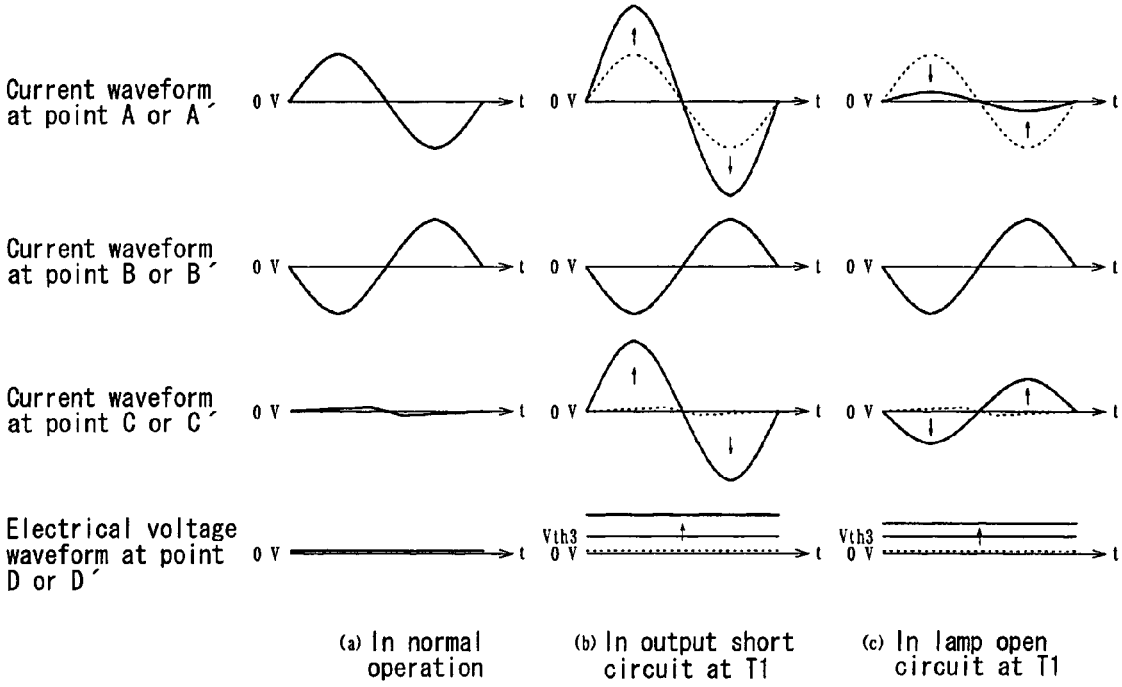
FIG. 2 is current waveform charts schematically showing a principle of detecting a malfunction of a lamp current in the discharge lamp lighting apparatus of FIG. 1.

For example, when the lighting circuit block LCa1 operates normally, the current waveforms at points A and B have their amplitudes shaped equal to each other and have their phases shifted by 180 degrees fro each other as shown at section (a) of FIG. 2. The current waveforms at corresponding points in the lighting circuit blocks LCa2 to LCan are shaped likewise, and consequently, when all the lighting circuit blocks LC1 to LCan operate normally, the currents of the lighting circuit blocks cancel out one another at point C of the sense resistor Rb1, and currents scarcely flow. Thus, the voltage applied to the positive input terminal (+) of the comparator CP1 is substantially zero V.

Since the reference voltage Vth3 applied to the negative input terminal (−) of the comparator CP1 is set at a predetermined value larger than 0 V, and since the voltage applied to the positive input terminal (+) of the comparator CP1 at a normal operation is smaller than the reference voltage Vth3 predetermined, the voltage outputted from the comparator CP1 is at a low level.

Likewise, the current waveforms at points A' and B' in the lighting circuit block LCa1 and also at corresponding points in the lighting circuit blocks LCa2 to LCan have their amplitudes shaped equal to each other and have their phases shifted by 180 degrees from each other at the normal operation, and the voltage outputted from the comparator CP1' is also at a low level. Consequently, when the discharge lamp lighting apparatus 10 operates normally, a voltage 25*b* to be inputted to the protection circuit 25 of the control circuit 11 remains at a low level.

The lamp currents flowing in the discharge lamps La1 to La2*n* are rectified respectively by the diodes Ds1 & Ds1', Ds2 & Ds2', Ds3 & Ds3', . . . and Ds2*n* & Ds2*n*' of the current sensing circuits Sa1 & Sa1', Sa2 & Sa2', . . . and Sbn & Sbn' disposed at the both ends of the discharge lamps La1, La2, . . . and La2*n*, and the maximum currents of the lamp currents flowing in the lighting circuits at the both ends of the discharge lamps La1 to Lan are converted into a feedback signal (voltage) 22*b* by the sense resistor Rc1 and feedbacked to the control circuit 11 as an input to the error amplifier 22. Thus, the discharge lamp lighting apparatus 10 is enabled to control lamp currents of a plurality of discharge lamps.

Description will next be made on the malfunction detecting operation in the discharge lamp lighting apparatus 10 when a malfunction occurs at any one of the step-up transformers T1 to T2*n*.

For example, when an output short circuit occurs at the step-up transformer T1, or when the discharge lamp La1 is broken, the current flowing in the lighting circuit of the lighting circuit block La1 increases. As a result, the amplitude of the current waveform at at least one of points A and A' becomes larger than that at a normal time as shown at section (b) of FIG. 2, and so a synthetic current of, for example, a current of several mA is generated at point C (and/or C') of the sense resistor Rb1 (and/or Rb1'). Consequently, a sense voltage corresponding to the synthetic current generated is inputted to the positive input terminal (+), namely point D (and/or D') of the comparator CP1 (and/or CP1').

Also, if a connector open circuit or a lamp open circuit occurs in the lighting circuit block LCa1, the current flowing in the lighting circuit of the lighting circuit block La1 decreases. As a result, the amplitude of the current waveform at at least one of points A and A' becomes smaller than at a normal time as shown at section (c) of FIG. 2, and so a synthesized current of, for example, several mA is generated at point C (and/or C') of the sense resistor Rb1 (and/or Rb1') as in the case described above. Consequently, a sense voltage corresponding to the synthetic current generated is inputted to the positive input terminal (+), namely point D (and/or D') of the comparator CP1 (and/or CP1').

In any of the cases described above, when the sense voltage exceeds the reference voltage Vth3 inputted to the negative input terminal (−) of the comparator CP1 (and/or the comparator CP1'), the output voltage of the comparator CP1 (and/or the comparator CP1') is switched from a low level to a high level, and the high level output voltage functions as a malfunction detecting signal. And, if the malfunction detecting signal is outputted from at least one of the malfunction detecting circuits CM1 and CM1', the voltage 25*b* to be inputted to the protection circuit 25 of the control circuit 11 is switched to a high level which indicates detection of a malfunction.

In the discharge lamp lighting apparatus 10, the protection circuit 25, when applied with the voltage 25*b* of a high level indicating detection of a malfunction, outputs a drive stop signal (voltage) 25*a* thereby causing a logic circuit 24 to stop generation of gate driving signals d1 to d4, thus stopping driving of the bridge circuits BR1 to Brn.

In the discharge lamp lighting apparatus 10 according to the first embodiment, the lamp currents flowing in the lighting circuits disposed at one ends of the plurality of discharge lamps La1 to La2*n* are synthesized on the common line e1, and the lamp currents flowing in the lighting circuits disposed at the other ends of the discharge lamps are synthesized on the common line e2, thus respectively synthesizing the lamp currents of the plurality of discharge lamps, such that at the normal operation time, the respective plurality of lamp currents synthesized which are phase-shifted 180 degrees fro each other are canceled out so as to make the synthetic current substantially zero, and at the malfunction time, the balance of the lamp currents is disturbed so as to generate a certain synthetic current, whereby an abnormal lamp current is detected by a sense voltage corresponding to the synthetic current. With this characteristic function, a malfunction is detected as an increase in sense voltage both with respect to abnormal increase of the lamp current and with respect to abnormal decrease thereof.

Accordingly, unlike the conventional discharge lamp lighting apparatus 100 (refer to FIG. 5) in which two sense circuits, each (for example, SC1) of which includes a sense resistor (for example, Ra1), a comparator (for example, CPo1) to determine the increase of current, and another comparator (for example, CPs1) to determine the decrease of current, must be provided for each of the discharge lamps La1 to La2*n* in order to reliably detect the malfunction of the lamp currents in the plurality of discharge lamps La1 to La2*n*, the discharge lamp lighting 10 according to the first embodiment is provided only with: two malfunction detecting circuits, each (fro example, CP1) of which include one sense resistor (for example, Rb1) common for the plurality of discharge lamps La1 to La2*n*; and two malfunction detecting circuits, each (for example, CM1) of which includes one comparator (for example, CP1) to determine the increase of the sense voltage. With this structure, the discharge lamp lighting apparatus 10 performs a malfunction detecting function equivalent to that of the discharge lamp lighting apparatus 100 of FIG. 5.

In the discharge lamp lighting apparatus 10, if a simple current sensing circuit (for example, Sa1) composed of one resistor (for example, Rs1) and one diode (for example, Ds1) is provided between the low voltage side output of each of the step-up transformers T1 to T2*n* and the common line e1/2*e*, then a feedback voltage for controlling lamp currents can be obtained in the same way as the sense circuits SC1 to SC4*n* shown in FIG. 5.

Consequently, in the discharge lamp lighting apparatus 10, the number of components required in a circuit to detect an abnormal current can be substantially reduced compared with a conventional discharge lamp lighting apparatus, a simplified sense circuit can be achieved at a lower cost, and the component mounting area can be reduced with such a simplified circuitry thus enabling easy downsizing of the discharge lamp lighting apparatus.

In the embodiment described above, two systems of current sensing circuits, that is, Sa1 to San and Sb1 to Sbn, and Sa1' to Sa1*n'* and Sa2' to Sa2*n'*, are provided, but the present invention does not necessarily have to incorporate both of the two current sensing circuit systems and may be duly carried out with provision of either one system of Sa1 to San and Sb1 to Sbn, or the other system of Sa1' to Sa1*n'* and Sa2' to Sa2*n'*. Also, the present invention does not necessarily have to include both of the two malfunction detecting circuits CM1 and CM1' and may be duly carried out with either one thereof corresponding to the current sensing circuit incorporated. The discharge lamps La1 to La2*n* are constituted by U-shape lamps in the embodiment, but the present invention is not limited to any specific shape of discharge lamps and may alternatively use quasi U-shape lamps or straight lamps.

A second embodiment of the present invention will be described with reference to FIG. 3. In the following description, any component parts corresponding to those of the discharge lamp lighting apparatus 10 of FIG. 1 are denoted by the same reference numerals, and a redundant description thereof will be omitted below.

Figure 3:
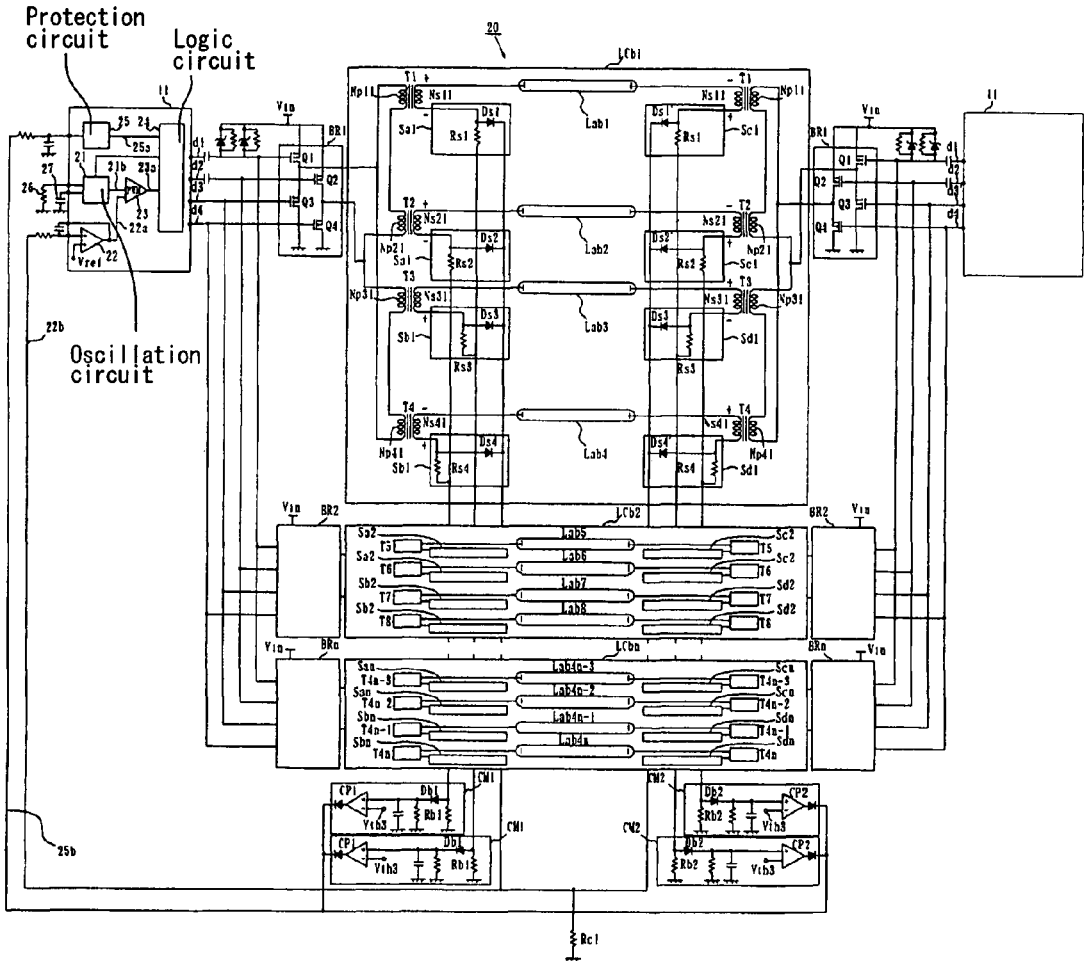
FIG. 3 is a circuit diagram of a discharge lamp lighting apparatus according to a second embodiment of the present invention.

Referring to FIG. 3, a discharge lamp lighting apparatus 20 according to the second embodiment is adapted to light, in a controlled manner, a plurality (4*n* pieces) of discharge lamps Lab1 to Lab4*n* each constituted by a straight cold cathode lamp, and includes: lighting circuit blocks LCb1, LCb2, . . . and LCbn connected to respective foursomes of discharge lamps Lab1 to Lab4, Lab5 to Lab8, . . . and Lab4*n*−3 to Lab4*n*; malfunction detecting circuits CM1, CM1', CM2 and CM2' connected to the lighting circuit blocks LCb1 to LCbn; bridge circuit pairs BR1+BR1', BR2+BR2', . . . and BRn+BRn' each pair provided at each of the lighting circuit blocks LCb1, LCb2, . . . and LCbn; and a control circuit 11 to drive the BR1 to BRn and BR1' to BRn' in a controlled manner (FIG. 3 shows two blocks each corresponding to the control circuit 1 for convenience sake, while the present embodiment uses one common control circuit 11).

The discharge lamp lighting apparatus 20 differs from the discharge lamp lighting apparatus 10 of FIG. 1 in that circuitries to perform functions equivalent to the functions of the lighting circuit blocks LCa1 to LCan and the bridge circuits BR1 to BRn of the discharge lamp lighting apparatus 10 are provided at the both sides of the discharge lamps Lab1 to Lab4*n*. The circuitry structure is detailed below.

The lighting circuit block LCb1 includes step-up transformers T1 to T4 and T1' to T4', and current sensing circuits Sa1, Sa1', Sb1, Sb1', Sc1, Sc1', Sd1 and Sd1', and explanation will be made on the circuitry shown at the left side of the discharge lamps Lab1 to Lab4 in FIG. 3.

The step-up transformer T1/T2/T3/T4 is with one output and includes a primary winding Np11/Np21/Np31/Np41 and a secondary winding Ns11/Ns21/Ns31/Ns41, wherein the primary windings Np11 and Np21 are connected in series to each other, and the primary windings Np31 and Np41 are connected in series to each other.

The series connection of the primary windings of Np11 and Np21 of the step-up transformers T1 and T2 and the series connection of the primary windings of Np31 and Np41 of the step-up transformers T3 and T4 are connected in parallel to each other between the connection point of switch elements Q1 and Q3 of the bridge circuit BR1 and the connection point of switch elements Q2 and Q4 of the bridge circuit BR1.

In the step-up transformer T1, one terminal of the secondary winding Ns11 constitutes a high voltage side output and is connected to one electrode of the discharge lamp Lab1 while the other terminal thereof constitutes a low voltage side output and is connected to the current sensing circuit Sa1, and in the step-up transformer T2, one terminal of the secondary winding Ns21 constitutes a high voltage side output and is connected to one electrode of the discharge lamp Lab2 while the other terminal thereof constitutes a low voltage side output and is connected to the currents sensing circuit Sa1'.

In the same way, in the step-up transformer T3, one terminal of the secondary winding Ns31 constitutes a high voltage side output and is connected to one electrode of the discharge lamp Lab3 while the other terminal thereof constitutes a low voltage side output and is connected to the current sensing circuit Sb1, and in the step-up transformer T4, one terminal of the secondary winding Ns41 constitutes a high voltage side output and is connected to one electrode of the discharge lamp Lab4 while the other terminal thereof constitutes a low voltage side output and is connected to the currents sensing circuit Sb1'.

The current sensing circuits Sa1, Sa1', Sb1 and Sb1' and the malfunction detecting circuits CM1 and CM1' are structured identically with those of the discharge lamp lighting apparatus 10, and the remaining lighting circuit blocks LCb2 to LCbn are structured identically with the lighting circuit block LCb1 explained above.

Accordingly, one terminals of resistors Rs1, Rs3, . . . and Rs4*n*−1 of the current sensing circuits Sa1 to San and Sb1 to Sbn, which are not connected to the secondary windings, are all connected to a common line e1 (first common line) which is connected to the malfunction detecting circuit CM1. In the same way, one terminals of resistors Rs2, Rs4, . . . and Rs4*n* of the current sensing circuits Sa1' to San' and Sb1' to Sbn', which are not connected to the secondary windings, are all connected to a common line e2 (first common line) which is connected to the malfunction detecting circuit CM1'.

In the lighting circuit blocks LCb1 to LCbn, the circuitry shown at the right side of the discharge lamps Lab1 to Lab4 in FIG. 3 is structured line-symmetrically with the circuitry shown at the left side of the discharge lamps Lab1 to Lab4 described above, specifically such that the step-up transformers Ti and Ti' symmetrically correspond to each other, the current sensing circuits Sai/Sai'/Sbi/Sbi'/ and Sci/Sci'/Sdi/Sdi symmetrically correspond to each other (where i=1, 2, . . . n), and the malfunction detecting circuits CM1/CM1' and CM2/CM2' symmetrically correspond to each other.

In the structure described above, one terminals of resistors Rs1', Rs3', . . . and Rs4*n*−1' of the current sensing circuits Sc1 to Scn and Sd1 to Sdn, which are not connected to the secondary windings, are all connected to a common line e3 (first common line) which is connected to the malfunction detecting circuit CM2. In the same way, one terminals of resistor Rs2', Rs4', . . . and Rs4*n* of the current sensing circuits Sc1' to Scn' and Sd1' to Sdn', which are not connected to the secondary windings, are all connected to a common line e4 (first common line) which is connected to the malfunction detecting circuit CM2'.

The anode of a diode is connected to the output terminal of each of comparators CP1, CD1', CP2 and CP2' of the malfunction detecting circuits CM1, CM1', CM2 and CM2', and the cathodes of all the four diodes are joined to one another and connected to a protection circuit 25 of the control circuit 11.

The cathodes of the diodes Ds1 to Ds4*n* and Ds1' to Ds4*n*' of the current sensing circuits Sa1 to San, Sa1' to San', Sb1 to Sbn, Sb1' to Sbn', Sc1 to Scn, Sc1' to Scn', Sd1 to Sdn and Sd1' to Sdn' are all connected to a common line f (second common line) which is connected to one terminal of a sense resistor Rc1 (second sense resistor) which has its other terminal grounded. And, the connection point of the resistor Rc1 and the common line f is connected to an error amplifier 22 of the control circuit 11.

In the discharge lamp lighting apparatus 20 according to the second embodiment, a pair of transformers (for example, T1+T1') connected to the both electrodes of a discharge lamp (for example, Lab1) are adapted to apply an opposite phase voltage across the both electrodes of the discharge lamp.

Further, in the common line e1, the lamp currents flowing in the current sensing circuits Sa1 to San are phase-shifted by 180 degrees from the lamp currents flowing in the current sensing circuits Sb1 to Sbn, and in the common line e2, the lamp currents flowing in the current circuits Sa1' to San' are phase-shifted by 180 degrees from the lamp currents flowing in the current sensing circuits Sb1' to Sbn'.

In the same way, in the common line e3, the lamp currents flowing in the current sensing circuits Sc1 to Scn are phase-shifted by 180 degrees from the lamp currents flowing in the sensing circuits Sd1 to Sdn, and in the common line e4, the lamp currents flowing in the current sensing circuits Sc1' to Scn' are phase-shifted by 180 degrees from the lamp current flowing in the sensing circuits Sd1' to Sdn'.

The discharge lamp lighting apparatus 20 structured as described above achieves the same effects as the discharge lamp 10.

In the second embodiment, the current sensing circuits are grouped into two systems, where one system is composed of Sa1 to San, San1' to San', Sb1 to Sbn and Sb1' to Sbn' disposed at one side of the discharge lamps Lab1 to Lab4*n*, and the other system is composed of Sc1 to Scn, Sc1' to Scn', Sd1 to Sdn and Sd1' to Sdn' disposed at the other side of the discharge lamps Lab1 to Lab4*n*, but the present invention does not necessarily have to incorporate both of the two current sensing circuit systems and may be duly carried out with either the system composed of Sc1 to Scn, Sc1' to Scn', Sd1 to Sdn and Sd1' to Sdn', or the system composed of Sc1 to Scn, Sc1' to Scn', Sd1 to Sdn and Sd1' to Sdn'. Also, the present invention does not necessarily have to include both of the two malfunction detecting circuit pair CM1+CM1' and CM2+CM2' and may be duly carried out with either the pair CM1+CM1' or the pair CM2+CM2' corresponding to the current sensing circuit incorporated. The discharge lamps La1 to La2*n* are constituted by U-shape lamps in the embodiment, but the present invention is not limited to any specific shape of discharge lamps and may alternatively use quasi U-shape lamps or straight lamps.

A third embodiment of the present invention will be described with reference to FIG. 4. In the following description, any component parts corresponding to those of the discharge lamp lighting apparatus 10 of FIG. 1 are denoted by the same reference numerals, and a redundant description thereof will be omitted below.

Figure 4:
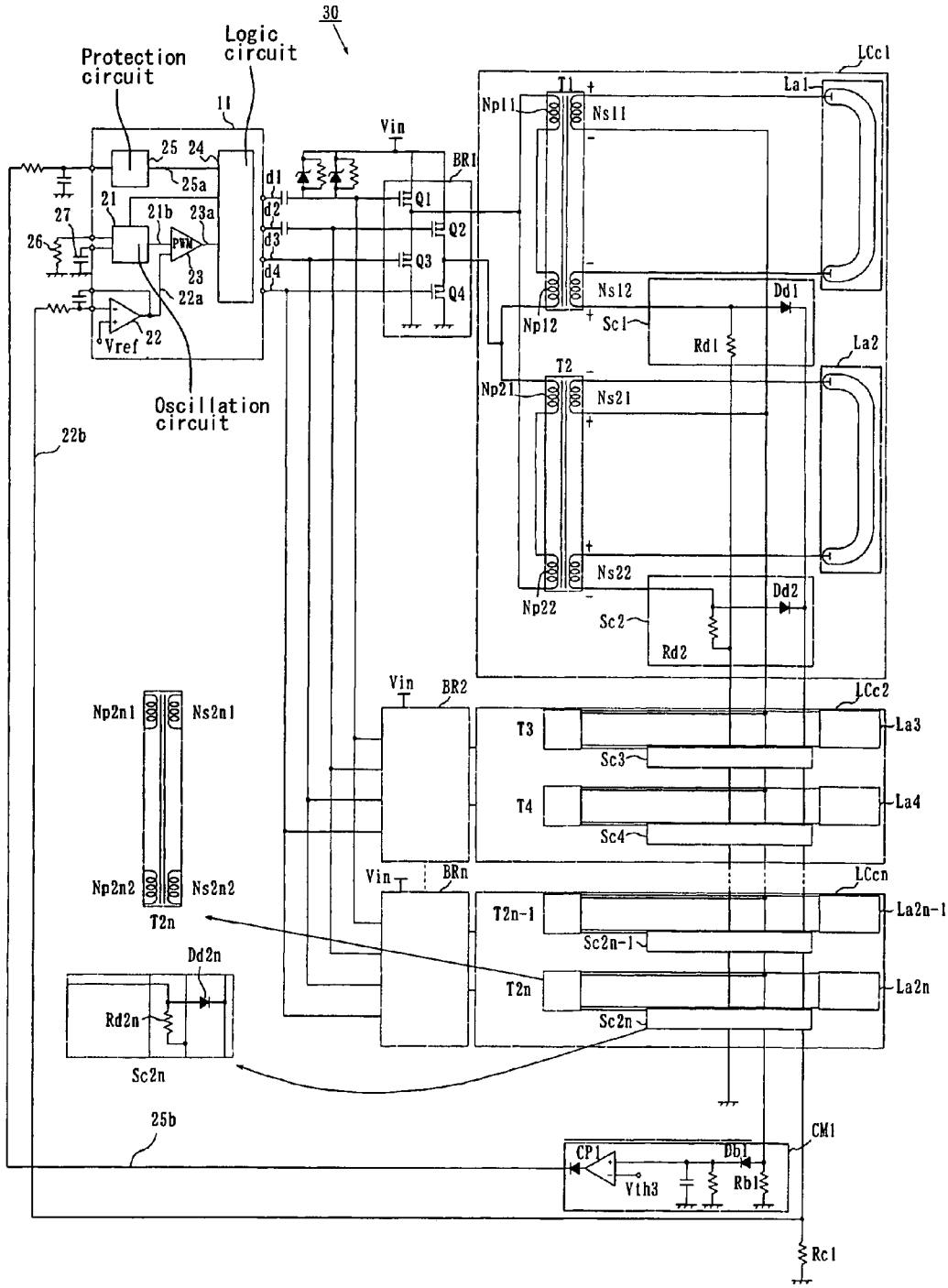
FIG. 4 is a circuit diagram of a discharge lamp lighting apparatus according to a third embodiment of the present invention.

Referring to FIG. 4, a discharge lamp lighting apparatus 30 according to the third embodiment basically has the same structure as the discharge lamp lighting apparatus 10 but differs therefrom in the respects described below.

Low voltage side outputs of respective secondary windings Ns11, Ns21, . . . and Ns2*n* 1 of step-up transformers T1, T2, . . . and T2*n* are connected directly to a common line e1 (first common line) without any current sensing circuits provided therebetween, and the common line e1 is connected to an only malfunction detecting circuit CM1 provided in the discharge lamp lighting apparatus 30. Also, low voltage side outputs of the respective remaining secondary windings Ns12, Ns22, . . . and Ns2*n* 2 of the step-up transformers T1, T2, . . . and T2*n* are connected respectively via resistors Rd1, Rd2, . . . and Rd2*n* of current sensing circuits Se1, Se2, . . . and Se2*n* to a common line e2 (first common line) which is directly grounded.

Accordingly, in the discharge lamp lighting apparatus 30, out of lamp currents flowing in the lighting circuits of discharge lamps La1 to La2*n*, lamp currents flowing in one electrodes (connected to one terminals of the secondary windings Ns11, Ns21, . . . Ns2*n* 1) of the discharge lamps La1 to La2*n* are synthesized on the common line e1, and a voltage corresponding to the synthetic current is sensed by a sense resistor Rb1 (first sense resistor) of the malfunction detecting circuit CM1. And, the voltage sensed is used for detecting an abnormal lamp current.

On the other hand, the low voltage side outputs of the secondary windings Ns12, Ns22, . . . and Ns2*n* 2, which have their high voltage side outputs connected to the other electrodes of the discharge lamps La1 to La2*n*, are used for controlling lamp currents. Specifically, the currents flowing in the low voltage side outputs are rectified respectively by diodes Dd1 to Dd2*n* of the current sensing circuits Se1 to Se2*n*, and the maximum currents of those currents are converted into a feedback signal (voltage) 22*b* by the sense resistor Rc1 and inputted to an error amplifier of a control circuit 11.

As described above, in the discharge lamp lighting apparatus 30 according to the third embodiment, no current sensing circuits are provided at the common line e1, and no malfunction detecting circuits are provided at the common line e2, thus enabling a further substantial reduction in the number of components compared with conventional discharge lamp lighting apparatuses. Also, in the discharge lamp lighting apparatus 30, even when a lamp open circuit occurs (lamp coming off) simultaneously at both of a pair of discharge lamps to which the low voltage side outputs of the step-up transformers with their phases shifted by 180 degrees from each other are connected, a malfunction is duly detected by means of the current sensing circuits.

While the present invention has been explained with respect to the specific exemplary embodiments, it is to be understood that the present invention is by no means limited thereto but encompasses various changes and modifications that will become possible within the scope of the technical ideas of the invention.

For example, discharge lamps do not necessarily have to be provided in an even number, and the present invention can be duly implemented with provision of an odd number of discharge lamps if there is provided at least one first common line to which the low voltage side outputs of secondary windings, whose high voltage side outputs are connected to one electrodes of respective different discharge lamps, are connected, and on which opposite phase currents with their phases shifted by 180 degrees from each other are synthesized in the same number.

Further, a current sensing circuit (for example, Sa1 in FIG. 1) is composed of a resistor (Rs1) and a diode (Ds1) in the embodiments described above, the present invention is not limited to such a composition arrangement of a current sensing circuit, and for example, a capacitor may be additionally provided in parallel with the resistor (Rs1) for reducing current noise.

Also, bridge circuits (for example, BR1 to BRn in FIG. 1) are full-bridge circuits in the embodiments described above, but the present invention can be duly carried out with half-bridge circuits each including two switch elements connected in series to each other. In FIGS. 1, 3 and 4, the high-side switch elements Q1 and Q3 are shown as p-channel MOSFETs, but the bridge circuit of the present invention is not limited to such a structure and may alternatively be structured only with n-channel MOSFETs provided that an appropriate high-side driver is employed. Also, all switch elements may be constituted by any electric power switch elements, for example, bipolar transistors, and IGBTs (insulated gate bipolar transistors).

And, the protection circuit 25 may not necessary have to constitute part of the control circuit 11 as described in the embodiments and may alternatively be structured as an independent circuit.

What is claimed is:

1. A discharge lamp lighting apparatus to light a plurality of discharge lamps, the apparatus comprising:

a step-up transformer group comprising at least one step-up transformer and having a plurality of outputs to which the plurality of discharge lamps are connected;

at least one bridge circuit connected to an input side of the step-up transformer group;

a control circuit to drive the bridge circuit in a controlled manner;

a plurality of current sensing circuits disposed at the low voltage side outputs of the plurality of outputs of the step-up transformer group and functioning to a lamp current of each of the discharge lamps;

at least one first common line to which at least two low voltage side outputs of the plurality of the outputs of the step-up transformer group are connected, wherein the low voltage side outputs connected to the first common line include two kinds of outputs provided in an equal number, and lamp currents flowing respectively in the two kinds of outputs are phase-shifted by 180 degrees from each other;

a second common line connected to outputs of the plurality of current sensing circuits;

a malfunction detecting circuit comprising a first sense resistor to convert into a sense voltage a synthetic current of the lamp currents synthesized on the first common line and a comparator to compare the sense voltage with a predetermined reference voltage, the malfunction detecting circuit functioning to output a malfunction detecting signal when the sense voltage exceeds the reference voltage a second sense resistor having one terminal thereof connected to the second common line and having the other terminal thereof connected to ground potential, the second sense resistor functioning to convert a maximum of the lamp current of each of the discharge lamps into a sense voltage, wherein the sense voltage of the second sense resistor is feedbacked to the control circuit as a feedback signal, whereby the lamp currents of the plurality of discharge lamps can be controlled; and a protection circuit to stop driving of the bridge circuit when the malfunction detecting circuit outputs the malfunction detecting signal.

2. A discharge lamp lighting apparatus according to claim 1, wherein the current sensing circuit comprises a resistor and a diode.

3. A discharge lamp lighting apparatus according to claim 1, wherein the protection circuit constitutes part, of the control circuit.

4. A discharge lamp lighting apparatus to light a plurality of discharge lamps, the apparatus comprising:

a step-up transformer group comprising at least one step-up transformer and having a plurality of outputs to which the plurality of discharge lamps are connected;

at least one bridge circuit connected to an input side of the step-up transformer group;

a control circuit to drive the bridge circuit in a controlled manner;

at least one first common line to which at least two low voltage side outputs of the plurality of the outputs of the step-up transformer group are connected, wherein the low voltage side outputs connected to the first common line include two kinds of outputs provided in an equal number, and lamp currents flowing respectively in the two kinds of outputs are phase-shifted by 180 degrees from each other;

a malfunction detecting circuit comprising a first sense resistor to convert into a sense voltage a synthetic current of the lamp currents synthesized on the first common line and a comparator to compare the sense voltage with a predetermined reference voltage, the malfunction detecting circuit functioning to output a malfunction detecting signal when the sense voltage exceeds the reference voltage, wherein the malfunction detecting circuit is disposed at the first common line to which low voltage side outputs of outputs out of the plurality of outputs of the step-up transformer group, high voltage side outputs of which are connected to one electrodes of the discharge lamps, are connected, and wherein low voltage side outputs of remaining outputs out of the plurality of outputs of the step-up transformer group, high voltage side outputs of which are connected to the other electrodes of the discharge lamps, are for controlling the lamp currents; and a protection circuit to stop driving of the bridge circuit when the malfunction detecting circuit outputs the malfunction detecting signal.

5. The discharge lamp lighting apparatus according to claim 4, wherein the current sensing circuit comprises a resistor and a diode.

6. The discharge lamp lighting apparatus according to claim 4, wherein the protection circuit constitutes part of the control circuit.

* * * * *